US011982167B1

(12) United States Patent
McGee et al.

(10) Patent No.: US 11,982,167 B1
(45) Date of Patent: May 14, 2024

(54) STRUCTURAL ENRICHED AIR RECOVERY (SEAR) FOR OIL RESERVOIRS

(71) Applicant: Phoenix Trust LLC, Dallas, TX (US)

(72) Inventors: Rick Alan McGee, Houston, TX (US); Michael Lee Fraim, Albuquerque, NM (US); Daniel Scott Dobson, Dallas, TX (US)

( * ) Notice: Subject to any disclaimer, the term of this patent is extended or adjusted under 35 U.S.C. 154(b) by 96 days.

(21) Appl. No.: 17/842,443

(22) Filed: Jun. 16, 2022

Related U.S. Application Data

(63) Continuation-in-part of application No. 17/573,208, filed on Jan. 11, 2022.

(51) Int. Cl.

| | |
|---|---|
| ***E21B 43/26*** | (2006.01) |
| ***E21B 43/00*** | (2006.01) |
| ***E21B 43/16*** | (2006.01) |
| ***E21B 43/243*** | (2006.01) |

(52) U.S. Cl.
CPC ..... *E21B 43/243* (2013.01); *E21B 43/164* (2013.01)

(58) Field of Classification Search
None
See application file for complete search history.

(56) References Cited

U.S. PATENT DOCUMENTS

| | | | | |
|---|---|---|---|---|
| 7,882,893 | B2 | 2/2011 | Fraim | |
| 2003/0080604 | A1 * | 5/2003 | Vinegar | E21B 43/24 166/256 |
| 2003/0141064 | A1 | 7/2003 | Roberson | |

OTHER PUBLICATIONS

Zangana, M. and Azzopardi, B, "Liquid film properties of gas-liquid flow in large diameter vertical pipe," Conference: Petroleum 2012, vol. 81 DOI: 10.2495/PmR120211.

(Continued)

*Primary Examiner* — Charles R Nold
(74) *Attorney, Agent, or Firm* — Egbert, McDaniel & Swartz, PLLC

(57) ABSTRACT

A method for enhanced oil recovery in a tilted reservoir includes the steps of: providing an injection well and at least one production well, the at least one production well provided at a greater depth in the tilted reservoir than the injection well; injecting carbon dioxide or nitrogen gas into the injection well; injecting enriched air into the injection well so as to cause ignition in the tilted reservoir; reducing production by the at least one production well; draining fluid from an area in the tilted reservoir up-dip of the injection well; and recovering the drained fluid by the at least one production well.

15 Claims, 8 Drawing Sheets

(56) References Cited

OTHER PUBLICATIONS

EIGA Guideline IGC Doc 33/97/E, "Cleaning of Equipment for Oxygen Service," Mar. 3, 1997, rev. 2006.
Wei Wei, Alan Rezazadeh, Jingyi Wang, Ian Gates, "An analysis of toe-to-heel air injection for heavy oil production using machine learning," Journal of Petroleum Science and Engineering 197 (2021) p. 108109.
Leonard J. Hvizdos; John V. Howard; George W. Roberts, "Enhanced Oil Recovery Through Oxygen-Enriched In-Situ Combustion: Test Results from the Forest Hill Field in Texas," J Pet Technol 35 (06), Jun. 83, p. 1061-1070.
H.J.M. Petit, "In-Situ Combustion with Oxygen-Enriched Air," SPE-16741-MS, SPE Annual Technical Conference and Exhibition, Dallas, Texas, Sep. 1987.
James Gordon Hansel; Michael Arthur Benning; John Matthew Fernbacher, "Oxygen In-Situ Combustion for Oil Recovery: Combustion Tube Tests," SPE-11253-PA, J Pet Technol 36 (07), Jul. 1984, p. 1139-1144.
J.R. Rodriguez; D.D. Mamora, "Analytical Model of the Combustion Zone in Oxygen-Enriched in Situ Combustion Tube Experiments," PETSOC-2005-072, Calgary, Alberta, Jun. 2005.

* cited by examiner

STRUCTURAL ENRICHED AIR RECOVERY (SEAR) FOR OIL RESERVOIRS

CROSS-REFERENCE TO RELATED APPLICATIONS

The present application is a continuation-in-part of U.S. application Ser. No. 17/573,208, filed on Jan. 11, 2022, presently pending.

FIELD OF INVENTION

The present invention relates generally to methods for oil extraction and more specifically to in-situ carbon dioxide and steam generation for thermal, top-down gas cap recovery of medium to heavy gravity oil in tilted reservoirs. This method is designed for tertiary oil recovery and can be used after water or chemical flooding.

BACKGROUND OF THE INVENTION

To extract the maximum amount of oil from the earth, at least one injection well and at least one production well is required per injection pattern in the target oil reservoir. For light to medium gravity oil reservoirs, water-flooding is used to maintain the pressure in the reservoir while the oil is extracted with the production wells. The areal sweep efficiency of the water displacement of oil phase is greatly reduced when there are permeability contrasts such as layering and channeling in the oil reservoir. The vertical sweep efficiency of the water displacement of the oil phase is greatly reduced when gravity stable displacement is not maintained in the water flooding of a tilted reservoir. For example, water phase will not displace attic oil above the production well in a tilted reservoir, but an injected gas phase can displace attic oil in a tilted reservoir because gas is lighter than the oil phase and will migrate into the attic above the production well.

In the Permian Basin, water alternating miscible gas injection has been used to improve sweep efficiency of medium gravity oil beyond conventional water flooding by reducing oil viscosity and swelling the oil with the injected gas phase. Miscible carbon dioxide has been the injected gas of choice since large volumes are available and the process is economically feasible. Attic oil recovery is still a challenge for the carbon dioxide injection because free or residual methane rich gas saturation increases the minimum miscibility pressure above the actual reservoir pressure in the attic thus reducing the desired effects of the carbon dioxide gas injection. The same carbon dioxide/methane gas dilution process applies to dead-end sand channels or carbonate reef structures for residual oil recovery.

Heavy oil reservoirs require thermal treatment to reduce the oil viscosity so the oil can flow through the reservoir and into the production well. Surface steam generation is the most economically feasible method for increasing the temperature in heavy oil reservoirs, except in cases where water is not available for steam generation. Steam injection provides the gas phase for top-down, gas cap, gravity drainage of the heavy oil to the production well, which can be represented by a 30-degree cone from the bottom perforation in the vertical or horizontal production well. Steam flooding cannot be effectively used as an economic oil recovery method for water flooded or natural water-drive heavy oil reservoirs due to the condensation of steam into to the free water phase in the heavy oil reservoir.

Tertiary oil recovery techniques are used after conventional steam or water flooding to mobilize residual oil into the displacing fluid phase and to recover bypassed oil in heterogeneous permeability reservoir volumes. For example, miscible carbon dioxide gas flooding after water flooding swells the oil phase and reduces residual oil saturation in the water-flooded swept pattern volume which results in the recovery of a portion of previously bypassed oil. But miscible carbon dioxide flooding will still be hindered by even a quarter inch thick clay/shale lens in the oil zone. However, in-situ generated steam/miscible carbon dioxide rich gas mixtures have significant advantages in recovering by-passed oil by altering permeability barriers within the reservoir layers. The localized thermal micro-fracturing of the rock matrix is due to in-situ generated heat caused by differential thermal expansion, thermal shrinkage of thin clay/limestone/dolomite intra-matrix barriers, and macro-fracturing thin clay/shale rich layer between reservoir rock lenses due to contact thermal shrinkage. Thus, in-situ generated steam/miscible carbon dioxide rich gas mixtures have had the best tertiary economic field development performance especially for medium to heavy gravity crude oil reservoirs.

Thermal In-Situ Combustion

In the process of in-situ thermal steam/miscible gas generation, a gas containing oxygen gas or a fluid containing hydrogen peroxide is pumped into the injection well. For attic oil recovery, gas phase oxygen injection is optimum and for basement oil recovery, liquid-based oxidant injection is optimum. As the gaseous or fluid oxidizer is pumped into the target oil formation, a fraction of the hydrocarbon in the reservoir volume is oxidized into heat and carbon dioxide and the connate brine is converted into steam. Shale, diatomite, and gypsum are thermally converted to a denser solid state which shrinks the rock matrix which in turn generates thermal micro-fractures. If the reservoir temperature is below the heavy oil/tar ignition temperature, a hydrocarbon with an ignition temperature lower than reservoir temperature is injected into the reservoir before injection of the oxidant. After ignition, the thermal front temperature will be above known heavy oil/tar ignition temperatures and the thermal front is self-sustaining. It is very important to avoid low temperature oxidation of heavy oil/tar since the process converts the hydrocarbon into an immobile solid coke "like" phase.

As the oxidation/high-temperature combustion front continues to expand in the oil reservoir, chromatographic separation will cause additional front formations. These separate zones are created from heat conduction and mass transport as well as chemical reduction and oxidation reactions occurring in the in-situ process. FIG. 1 shows detailed flood fronts generated for prior art conventional in-situ combustion. The fronts created from in-situ steam/carbon dioxide generation include coking/cracking zone, stripping/vaporization zone, steam plateau, hot condensate bank, carbon dioxide rich miscible displacement gas zone, up-graded oil bank, mobile residuum emulsion bank, and hot brine zone.

The high-temperature combustion front is only a few inches thick in the reservoir and the active combustion front travels across the surface between the oxygen rich gas phase and the coking/cracking zone. The sudden expansion of the combustion flue gases gives the burn front a reactionary force to move along the interface between the expanding gas cap and the coking/cracking zone. The movement can be in a rotational mode or a back-and-forth linear mode depending on the shape of the existing combustion front in the reservoir volume.

The coke fuel for the oxidation/high temperature combustion front is generated from the thermal cracking zone. The amount of coke generated determines the combustion front velocity and the amount of oxygen required to move the combustion front. If the amount of coke is less than required to raise the reservoir temperature above the ignition temperature, then the burn front surface will stop moving and for this case, natural gas can be co-injected with the oxygen gas with a nearby injection well or a dual completed injection well to create a stationary burn front to generate incremental heat to maintain the combustion front above the ignition temperature.

Downstream of the thermal cracking zone is the cracking/vaporization zone. In the cracking/vaporization zone, crude oil is modified by the high temperature of the combustion process and the lighter crude oil components are stripped by the gases generated from the combustion process. The lighter oil components condense and mix with displaced crude oil as the combustion gases flow through the rock matrix. As the heavier oil fractions continue to pyrolyze, they release additional light oil fractions that are also vaporized by the combustion gases. Field experience shows the lighter component addition to the original crude oil can increase the API gravity by up to 4 units. The API gravity increase can reduce the heavy oil viscosity by a factor of two to three by the reduction asphaltenes in the remaining liquid oil phase.

The chemical reactions associated with the in-situ combustion process for heavy crude oil and tar are typically complex and numerous even under laboratory test conditions. Associated low-temperature oxidation reactions are heterogeneous gas/liquid reactions producing partially oxygenated asphaltene like compounds and a small amount of carbon monoxide gas. These reactions increase the heavy oil or tar viscosity and may significantly reduce the sweep efficiency of the in-situ combustion flood. Medium-temperature reactions form the fuel for the combustion zone by cracking and pyrolysis of heavy hydrocarbon fractions. If the crude contains sulfur, the cracking reactions will generate hydrogen sulfide gas. High-temperature oxidation reactions are heterogeneous H—C bond breaking reactions that form a light end crude oil fraction along with solid fuel (coke) that reacts with oxygen gas to form steam and carbon dioxide gas.

Zones that were only exposed to low-temperature oxidation reactions can switch to high-temperature oxidation reactions as the reservoir formation heats up which in turn can cause a back burn to the injection well. The intense heat can cause injection well casing or cement damage by thermal expansion or splitting the casing with a large pressure pulse generated inside the casing. Low-temperature oxidation mode is usually caused by improper ignition techniques.

The purpose of the invention is to solve some of the current injection and production problems that exist with modern in-situ steam and/or carbon dioxide generation for tertiary enhanced oil recovery of tilted oil reservoirs with attic oil and oil reservoirs that have a pinch-out geological boundary.

BRIEF SUMMARY OF THE INVENTION

The foregoing needs are met for tertiary production of medium/heavy oil/tar formations, to a great extent, by certain embodiments of the present invention.

In an embodiment, the present invention is a method for enhanced oil recovery in a tilted reservoir including the following steps: providing an injection well and at least one production well, the at least one production well provided at a greater depth in the tilted reservoir than the injection well; injecting carbon dioxide or nitrogen gas into the injection well; injecting enriched air into the injection well so as to cause ignition in the tilted reservoir; reducing withdrawal by the at least one production well; draining fluid from an area in the tilted reservoir up-dip of the injection well; and recovering the drained fluid by the at least one production well.

In an embodiment, the method further includes sequestering produced carbon dioxide by injection into the injection well.

In an embodiment, the step of injecting carbon dioxide or nitrogen gas into the injection well includes creation of a buffer zone around a wellbore of the injection well for suppressing an initial pressure pulse from ignition in the tilted reservoir.

In an embodiment, prior to the step of reducing withdrawal by the at least one production well, a combustion zone is created after ignition will move downdip in the tilted reservoir toward the at least one production well. After the step of reducing withdrawal by the at least one production well, the combustion zone preferably moves updip in the tilted reservoir toward an attic of the tilted reservoir.

In an embodiment, the enriched air is an oxygen gas mixture comprising between 0 and 65 vol % nitrogen gas, less than 6 vol % argon gas, between 0 and 80 vol % carbon dioxide gas, less than 5 vol % hydrocarbon gas, and between 25 and 96 vol % oxygen gas.

In an embodiment, compressed air (~21% oxygen gas) is injected into the well at low flow rates (8 Mscf/d to 50 Mscf/d; wherein Mscf/d is thousand standard cubic feet per day) for a short term (i.e. less than one month) to create a coke zone around the injection well to prevent back flow of liquid oil phase during ignition with enriched air injection. The target radius for creating coke around the injection well is between 30 and 50 feet. The solid coke phase creates an immobile liquid oil phase while maintaining a high gas relative permeability for gas injection into the reservoir.

In an embodiment, the injection well utilizes an injection tubing comprising at least one of a composite plastic coating and a fiberglass tubing withing steel tubing. The method further includes the step of injecting fogged or foamed freshwater with 2-7% surfactant and 10-67% glycerin to form a liquid film to protect the injection tubing.

In an embodiment, the injection well comprises a plurality of injection wells respectively provided in isolated layers or attic pinch-out fingers of the tilted reservoir. The method may further include micro-seismic and/or 4D seismic tracking of at least one combustion zone created after ignition in the tilted reservoir.

In an embodiment, the at least one production well comprises a plurality of production wells. The method may further include converting one or more of the plurality of production wells into one or more injection wells for injecting enriched air. The method may also include converting one or more of the converted production wells into one or more carbon dioxide injection wells, and redirecting a combustion front upwardly in the tilted reservoir by injecting carbon dioxide in the carbon dioxide injection well or wells. The method may also include converting one or more of the converted production wells into one or more hydrocarbon injection wells; and establishing a stationary combustion front so as to expand steam and carbon dioxide fronts upwardly in the tilted reservoir or downwardly into an oil layer.

In an embodiment, the method further includes cycling a pressure in the location in the tilted reservoir up-dip of the production well by adjusting at least one of an injection gas rate in the injection well and a production rate in the at least one production well. Preferably, the pressure is cycled by at least 200 psi.

According to one embodiment, a method of medium/heavy oil/tar zone production is provided for attic oil recovery in a water flooded or natural water drive oil reservoir. The method includes requires at least one injection well and at least one production well in the target formation. The method also includes pumping a mixture of enriched air (30-100 mole % oxygen, balance other gases) and fogging or foaming a liquid water phase with a surfactant based wetting agent and viscosifier into the injection well tubing which in turn will coat the tubing with a film of non-combustible liquid. The non-combustible liquid will gravity segregate around the injection well bore and help prevent back burning from touching the injection well cement sheath. In addition, the method prevents back burning into the injection wellbore and ignition in the production wellbore by real time micro-seismic tracking of burn fronts in each oil reservoir layer. In addition, possible back-burning around the injection well casing cement sheath is monitored in real time with digital temperature surveys. Neat oxygen gas can be used for shallow reservoirs less than 1500 ft depth because the injection pressure is less than 1000 psi and the combustion front temperature is lower than 700 Fahrenheit.

In addition to the embodiments above, according to certain embodiments of the present invention, the controlled ignition process of heavy oil/tar in the reservoir volume near the injection well is a short-term transition between low-temperature oxidation and high-temperature oxidation to prevent the initial pressure pulse of the ignition of oil in the formation from exceeding the fracture gradient in the formation. Carbon dioxide gas is injected into the reservoir around the injection well to provide fluid compressibility to absorb the pressure pulse generated during the controlled ignition process.

Heavy oil or tar will not gravity segregate or drain back into the injected gas within the timeframe of ignition of an injection well for tilted reservoirs. On other hand, medium and light crude oils will gravity drain into the injected carbon dioxide gas volume, reducing the fluid compressibility around the injection well. Ignition of light to medium gravity crude oil reservoir has a shorter ignition time window than heavy oil because of the gravity segregation of carbon dioxide-expanded oil phase flowback into the miscible swept zone around the injection wellbore before the high-temperature oxidation ignition takes place. If the ignition takes more than 48 hours in flat reservoir layers, then the carbon dioxide gas injection is repeated, and the controlled ignition process is started over. In the tilted light oil reservoirs, for every 24-hour day of attempting a controlled ignition process, a 1-2-hour slug of carbon dioxide gas should be injected to remove migrated oil phase and prevent the initial pressure pulse of the ignition of oil in the formation from exceeding fracture gradient or back burning to the injection well casing in a tilted reservoir.

In either case, the high-temperature oxidation mode can be ignited with the injection of a low flash point fluid such as linseed/flaxseed oil. Carbon dioxide rich gas is injected in the reservoir to create at least a 50 ft radius of high gas saturation around the injection well bore to prevent the ignition pressure pulse from exceeding the fracture gradient of the reservoir rock especially if the reservoir rock has a permeability less than 50 millidarcies. The near injection well volume is intentionally saturated with carbon dioxide rich gas to provide fluid compressibility in the near wellbore volume.

If the heavy oil is in a solid-like tar phase at reservoir temperature, a solvent liquid such as naphtha or benzene can be mixed up to 30% by weight with the carbon dioxide gas until the injectivity of the gas phase is increased to support combustion with oxygen gas. Afterwards but prior to the controlled ignition process with oxygen rich gas, dry carbon dioxide gas is injected to provide gas saturation and fluid compressibility around the injection well.

Long term nitrogen gas injection is not recommended to provide the gas saturation around the injection well due to its tendency to gravity segregate rapidly in tilted reservoirs within the time interval required to ignite the oil phase which can cause a back burn event or a large pressure pulse after ignition. Nitrogen gas also increases coke generation during crude oil pyrolysis.

In addition to the above, according to certain embodiments of the invention, a forward combustion method generates a miscible or near-miscible mixture of carbon dioxide and condensed light oil fraction with the original crude oil. The near-miscible liquid hydrocarbon mixture reduces residual oil saturation and heavy oil viscosity down dip of the injection well which enhances gravity drainage and lateral displacement of the hydrocarbon and brine phases toward a production well.

Water flooding in a tilted reservoir will displace the oil phase mostly down dip from the injection well, thus leaving oil in the up-dip portion of the oil reservoir. The up-dip portion of the reservoir is called the attic. For attic oil to gravity drain downwards after water flooding in a tilted reservoir, a gas phase must be created within or near the attic oil volume to provide a pathway for oil flow. The gas phase provides the catalyst for downward gravity flow of the oil, i.e., the difference in density between gas and oil phase. To gravity drain heavy oil/tar at economic production rates, the oil viscosity must be reduced below 10 cp with the addition of heat so the liquid phase can flow down dip with a minimum of 1-2 degrees of tilt in the oil formation.

Also, according to certain embodiments of the invention, a forward combustion method is used to create a channel for gas migration to the top of each layer in the attic oil accumulation. By burning in high temperature mode and reservoir pressure below 1500 psi, the forward combustion front will gravity override in the uppermost couple of feet of the oil zone until the combustion front reaches the top of the attic. Then, reservoir pressure can be increased to above 1500 psi while the forward combustion front reverses direction to make a gravity stable displacement front with near-miscible carbon dioxide rich phase gas for pushing the attic oil phase down-dip to the production wells. The oxygen gas injection in the injection well must be balanced with the oil and water production at the production well to prevent over pressuring the oil formation or pushing oxygen gas phase towards a production well pressure sink.

Also, according to certain embodiments of the invention, the oxygen injection and the oil production rates are adjusted to cycle the average reservoir pressure in the attic by at least 200 psi over 2-3-month periods. The combustion front generates a carbon dioxide rich gas and light end fraction which will dilute the heavy oil phase in the attic by swelling. Thin discontinuous sand lenses in proximity of the main sand lens will expel heavy oil saturated with carbon dioxide gas into the main sand lens due to the thermal expansion from heat transfer from the forward combustion front. The cycling of average reservoir pressure in the attic will allow the solution gas drive mechanism to displace oil from thin sand lenses, low permeability zones, or dead-end pore volume zones to re-saturate the high permeability swept zone. The re-saturated oil is then gravity drained to the production well during the next pressure cycle as the carbon dioxide rich gas expands into the attic oil volume.

According to still another embodiment of the present invention, vertical production wells next to the attic oil can be converted to oxygen gas injection wells or used as a strike flue gas producer or oil production wells before conversion to oxygen injection wells. For the injection well completion, the perforated interval is plugged back to the upper 1-2 ft of each isolated zone. After the injection well is used for oxygen gas injection, the well can be converted to a recycled carbon dioxide gas injector to maintain pressure in the gas phase as the attic oil continues to gravity drain towards the down dip production well. If additional heat is required to reduce the oil viscosity in the attic, the injection well can be converted to a natural gas injection well to create a stationary burn front from offset oxygen gas injection wells. Natural gas burning with oxygen gas will create a very intense heat source to melt even a solid tar layer in the heavy oil reservoir.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the concept upon which this disclosure is based may readily be utilized as a basis for the disclosure of other structures, methods, and systems for carrying out the several purposes of the present invention. It is important, therefore, that the claims be regarded as including such equivalent constructions insofar as they do not depart from the spirt and scope of the present invention.

DETAILED DESCRIPTION OF THE INVENTION

Figure 1:
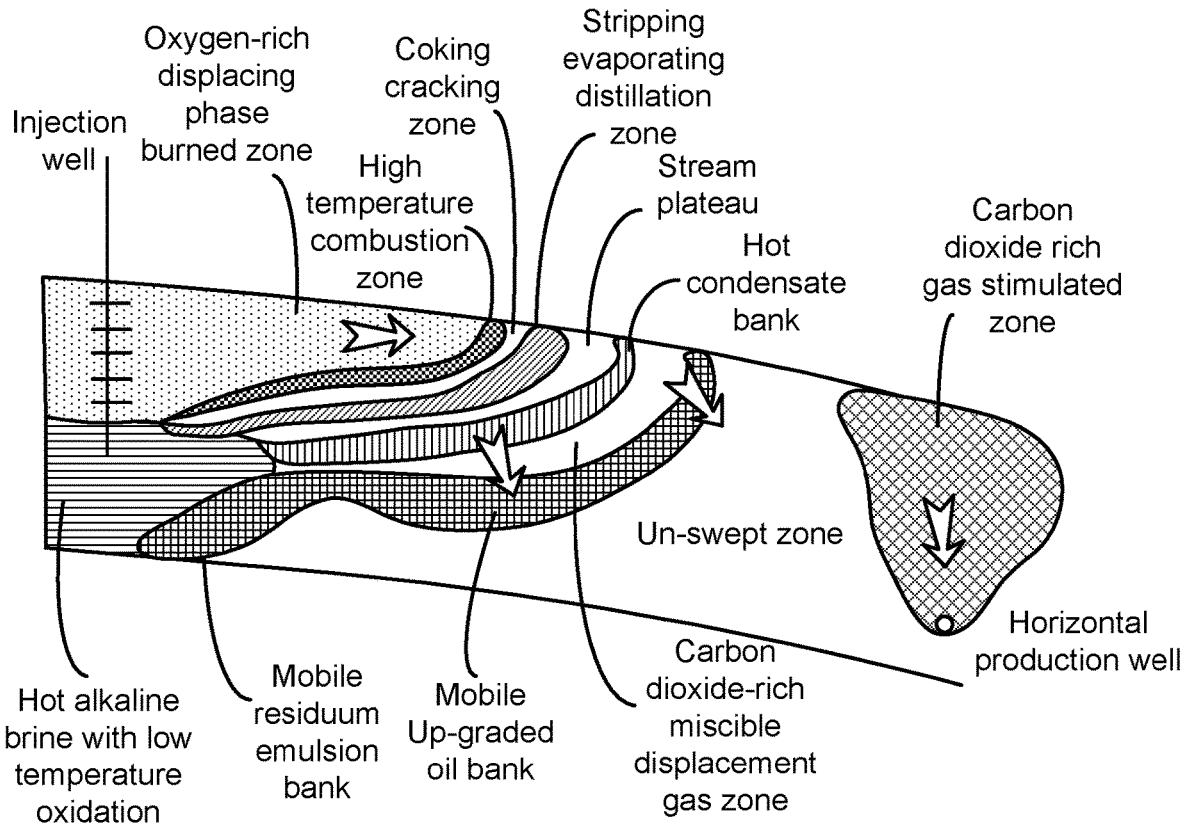
FIG. 1 PRIOR ART
FIG. 1: Illustration of conventional, top-down, in-situ combustion method showing the major fronts generated by the thermal processes. Multiple banks are present between the injection well and production well including: an oxygen rich gas volume, a combustion zone, a coking/cracking zone, a stripping/evaporation/distillation zone, a steam plateau, a hot condensate bank, a carbon dioxide rich gas zone, a mobile upgraded oil bank, and an un-swept zone. Also included is the carbon dioxide gas break out around the horizontal production well bore if the bottom hole pressure is below the bubble point of the carbon dioxide saturated oil.

The invention will now be described with reference to the drawing figures, in which like reference numerals or alphanumeric characters refer to like parts throughout. The method of the present invention, which may be referred to as Structural Enriched Air Recovery (SEAR) for oil reservoirs, uses in-situ combustion with near pure oxygen gas to generate heat, carbon dioxide and steam. According to this technique, first gas saturation is created below the attic oil accumulation and then the combustion front 40 is directed to gravity override the heavy oil in the attic of the oil reservoir. As the heavy oil viscosity is reduced below 10 cp, the liquid phase gravity drains down dip to the production wells. The water saturation from the previous water flood or natural water drive is converted into steam to augment expansion of the gas chest below the attic oil volume and enhance gravity drainage of heavy oil to the down dip production wells.

The maturity of each front as shown in FIG. 1 does not necessarily happen early in the in-situ carbon dioxide generation due to the instability of the interface of gas migrating to the top of the attic volume while the oil and water phases are migrating down to a production well. While the various processes and fronts occur simultaneously in FIG. 1, they do not mature at the same rate due to heat and mass balance in the reservoir. For example, the steam front will only form if there is enough heat remaining after the vaporization of formation water and heating of the reservoir rock. The carbon dioxide rich gas phase can form if the oil phase is not completely miscible, otherwise the carbon dioxide condenses into the liquid oil phase. Thus, each front shown in FIG. 1 may not mature to the idealized representation shown in FIG. 1 in the actual oil reservoir, but front order will remain the same if heat and mass are available to generate the mature front.

According to certain embodiments of the present invention, less than 5% nitrogen gas contamination is pumped into the oxygen gas injection well. In other words, air, or enriched air with high N2 content is not used, as nitrogen gas increases fuel laydown in the thermal cracking zone and increases the minimum miscibility pressure of the carbon dioxide rich flue gas generated from the combustion of residuum ends of the heavy crude oil. If the oil reservoir exhibits layering with permeability contrast or if multiple layers are perforated, air (~21% oxygen gas) can be pumped into the injection well at low flow rates (8 Mscf/d to 50 Mscf/d; wherein Mscf/d is thousand standard cubic feet per day) for a short term (i.e. less than one month) to intentionally coke the oil phase in each layer before ignition with enriched air. The coked oil radius should range from 30 to 50 ft. The solid coke in the pore space will create an immobile oil phase around the injection wellbore to prevent back burn into the well bore during enriched air ignition pressure events while still maintaining high gas injectivity into each zone.

Rather, according to certain embodiments of the present invention, near pure oxygen is pumped into the injection well or a mixture of near pure carbon dioxide and oxygen gas. A small amount of water and surfactant can be co-injected with the oxygen gas to protect the tubing and near wellbore volume from the heat of ignition and the subsequent nearby combustion zone.

Before ignition of the injection well, carbon dioxide gas is injected into the oil formation to provide gas saturation create a buffer zone to absorb the pressure pulse of ignition of the oil phase in the reservoir. After ignition of the oil phase in the reservoir, the oxygen gas injection drives the combustion front 40 away from the injection well. The above notwithstanding, it should be noted that oil combustion with near pure oxygen gas results in the production of intense heat, carbon dioxide gas, and steam. Steam is created from the combustion process and from the vaporization of formation water phase. The oil phase adjacent to the steam front effectively gets distilled. As such, a portion of the oil is converted to residuum while the lighter ends are vaporized and mix with the carbon dioxide gas making it a dense phase compressible fluid. As the water phase saturates with carbon dioxide gas, the carbonated water phase becomes heavier than the unsaturated water phase and migrates down dip towards an active production well.

Initially, after ignition of the oil reservoir, the carbon dioxide gas at reservoir temperature that did not condense into the oil or water phases will become a dense phase fluid with a density approaching the oil phase density. Hence, certain embodiments of the present invention use this fact to drive a dense phase carbon dioxide gas mixture down dip towards an active production well to generate a gaseous volume for the attic oil to gravity drain into once the combustion front 40 is directed upward towards the attic top.

After creation of the gaseous volume to drain the attic oil into, the production of oil and water is matched with the gravity drainage of the heavy oil from the attic to cause the combustion front 40 to gravity segregate to the top of the attic due to gravity segregation of a hot gas. The combustion front 40 will migrate to the upper couple feet of each layer, sand lens, or finger in the pinch-out of the oil reservoir boundary. Upgraded hot oil will counter flow down dip to the active production well due to the tilt and low oil viscosity. Thus, certain embodiments of the present invention use this fact of gravity segregation to recover attic heavy oil that cannot be recovered with water flooding, carbon dioxide flooding or conventional steam flooding.

Figure 2:
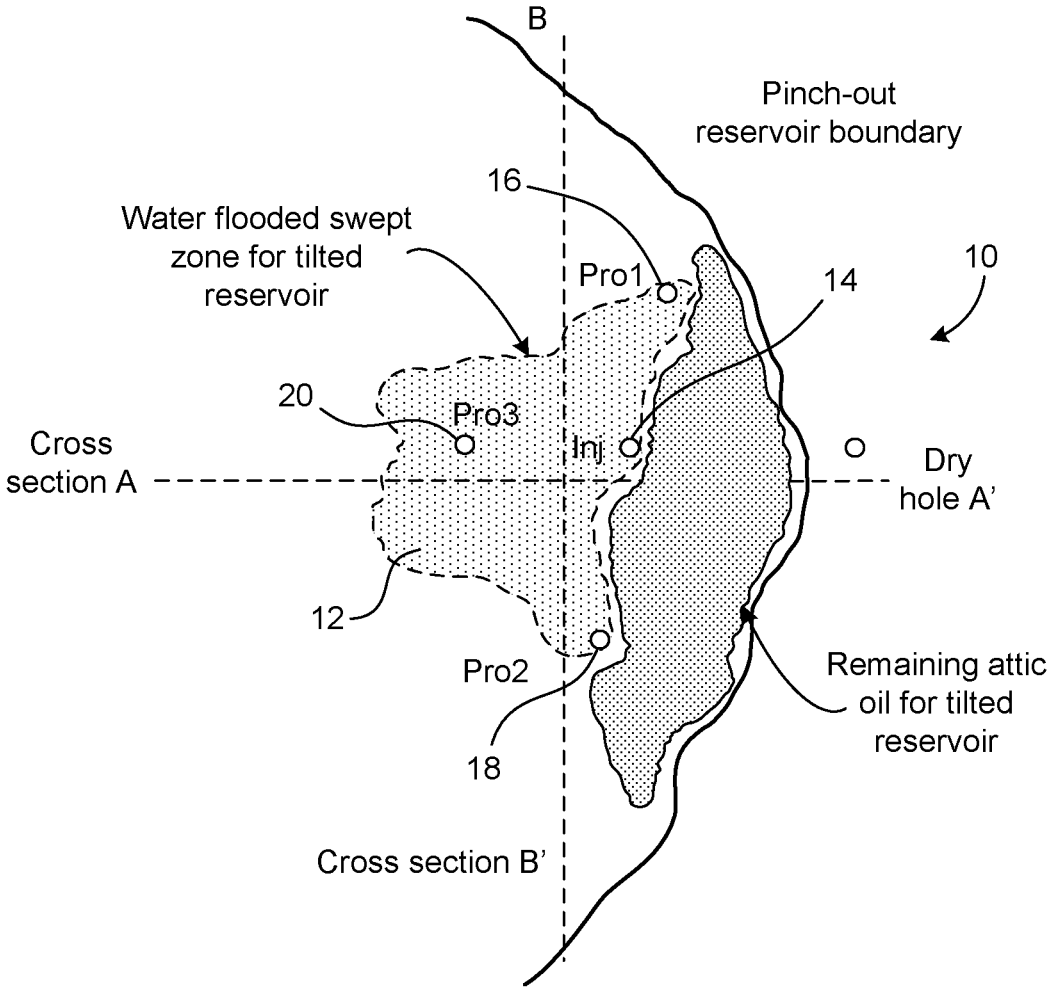
FIG. 2: An area view of a typical tilted oil reservoir with a geological pinch-out trap that has been pattern water flooded with vertical well bores. The waterflooded swept area is shown with dotted arrow pattern and the vertical well locations are represented with filled circles. Also shown is the attic oil in a dotted pattern at the top of the trap that was not swept by the water flood.
Figure 3:
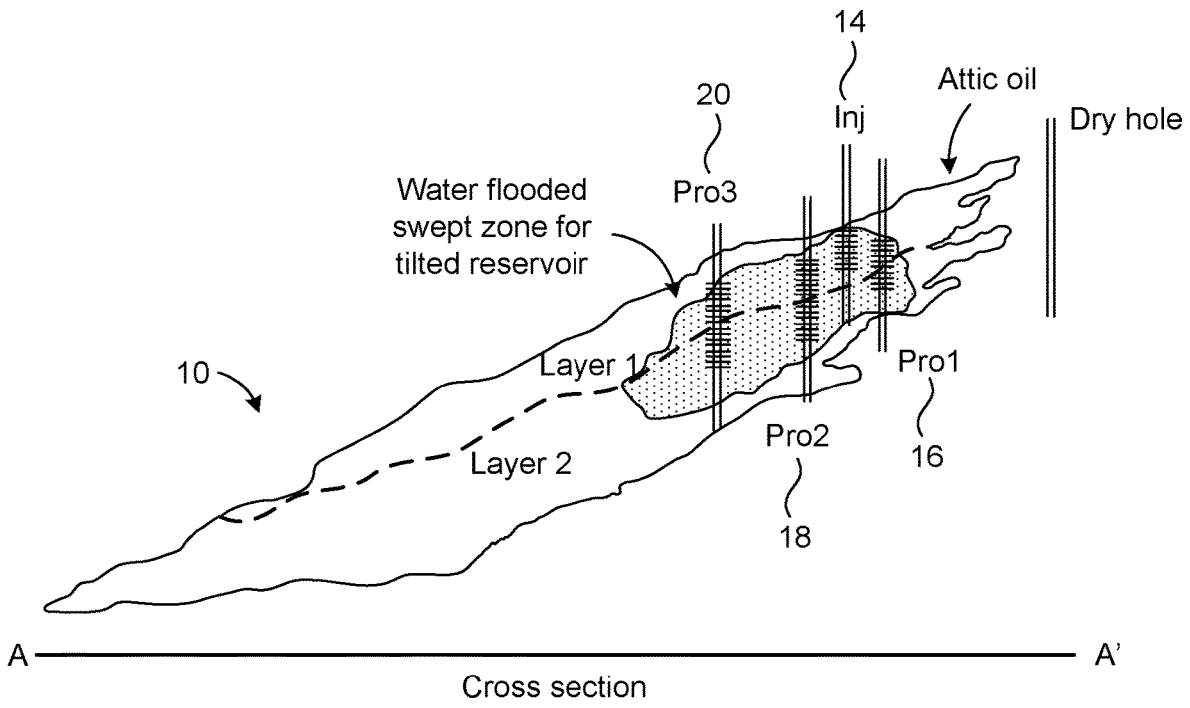
FIG. 3: A cross sectional view of a pattern water flood swept volume showing the location of the wells and perforated intervals. The waterflooded swept cross-sectional area is shown with dotted pattern. The tilt of the oil reservoir has been vertically exaggerated. Layer 1 has a lower reservoir matrix permeability than layer 2. The fingers of the pinch-out in the attic of the reservoir have lower reservoir matrix permeability than the main body of each layer.

FIG. 2 shows an aerial view of a selected section of a tilted oil reservoir 10 that has been pattern water flooded. The waterflooded swept zone 12 is shown with the dotted region between the injector 14 (Inj) and three producing wells 16, 18 and 20 (Pro1, Pro2 and Pro3, respectively). The vertical producing and injection well locations are represented by solid dots. The upper reservoir boundary is a geological pinch-out between shale lenses. The dotted lines labeled A-A' and B-B' are reservoir cross sections in the West-East direction and North-South direction. FIG. 3 shows the oil saturation above the vertical producing wells 16 and 18 (Pro1 and Pro2) and the area up dip of the injection well (Inj) is at original conditions and has not swept by water flooding because of the pinch-out permeability barrier. The un-swept oil saturation is called attic oil since the oil is located above and to the sides of the production and injection completion intervals. Injected water cannot flow against a permeability barrier to sweep the oil phase out of the attic. Note that the waterflooded swept are is shown with a dotted pattern.

Field experience shows that carbon dioxide gas at reservoir temperature will not cause gravity drainage the oil phase at economic production rates into vertical producing wells 16 and 18 (Pro1 and Pro2) because the heavy oil viscosity is too high. Steam injection into the injection well 14 (Inj) is also not an economical solution because the steam gas phase condenses into a liquid water phase in the thin pinch-out sand lens and this condensation of steam to liquid water effectively prevents gravity drainage of the heavy oil phase to the vertical producing wells. The condensation of steam in the thin sand layer is due to the heat transfer to the surrounding shale layers. The in-situ oxidation of the attic oil saturation with near pure oxygen or oxygen/carbon dioxide gas mixture will provide enough heat to reduce the heavy oil viscosity below 10 cp and maintain the gas phase in the attic so that the upgraded heavy oil phase will gravity drain to the vertical production wells 16, 18 and 20 (Pro1, Pro2 and Pro3, respectively).

Figure 4:
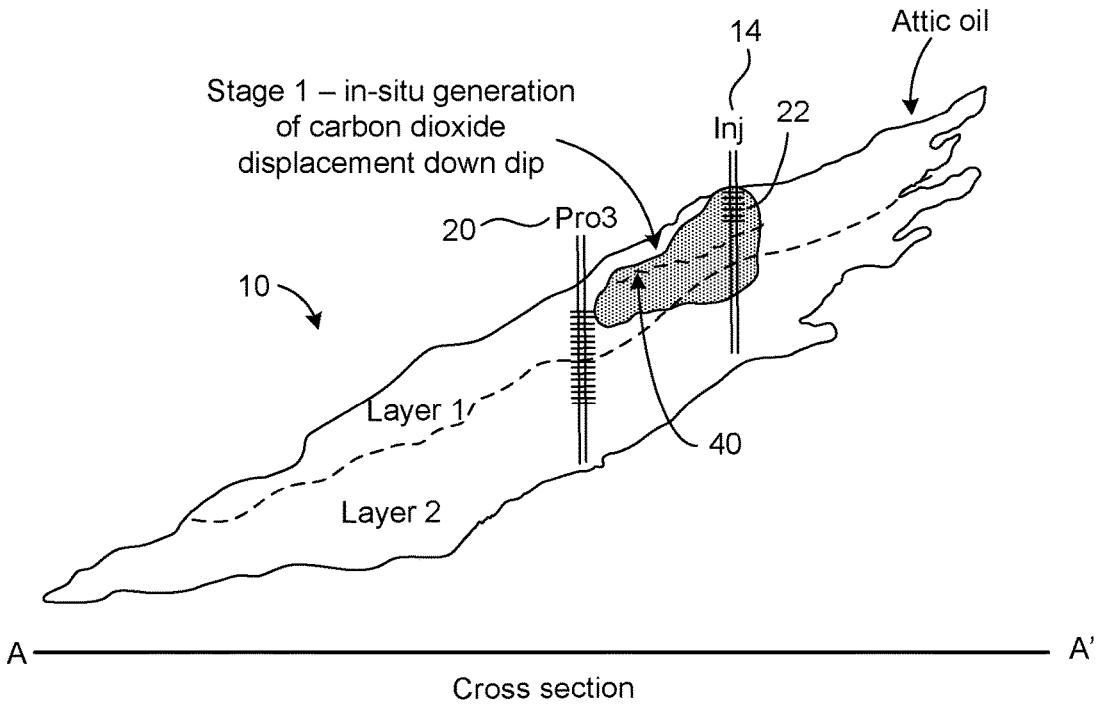
FIG. 4: End of stage 1 where the carbon dioxide rich gas generated from the in-situ combustion front was driven down dip to production well Pro3 by pumping the fluid level below the perforations. The combustion front did not intercept the wellbore, but the carbon dioxide front did. The steam front did not mature into a front due to condensation of steam into the water phase previously injected during water flood operations. Injected gas increased gas saturation by replacing water saturation and there was some oil phase production with the carbon dioxide gas production in production well Pro3. Production well Pro3 was shut-in to expand steam and carbon dioxide gas fronts towards production wells Pro1 and Pro2. Micro seismic was used to track the combustion front 3-D expansion in the reservoir.

The first stage of the attic oil production technique is to create gas phase void space (gaseous volume) below the injection well 14 (Inj) by shutting-in producing wells 16 and 18 (Pro1 and Pro2) and pumping down (the liquid level or bottom hole pressure in) producing well 20 (Pro3) so the in-situ produced carbon dioxide will displace the mobile water phase from injection well 14 (Inj) to the production well 20 (Pro3) as shown in FIG. 4, (A-A' cross section views of the tilted reservoir). The carbon dioxide concentration will increase above 85% in the produced gas and the heavy oil cut will also increase as the oxidation front approaches production well 20 (Pro3) as shown in FIG. 4. Initially, the generated carbon dioxide cannot gravity segregate towards the attic because there is not enough void space (gaseous volume 22; illustrated by the hatched area in FIG. 4) for the heavy oil phase to flow into since previous injected water occupies that volume below the injection well.

For tilted oil reservoirs, the counter-flow of the upgraded oil phase could cause back burning to the injection well 14 so the bottom hole temperature should be recorded in real time as a preventative measure. Hot upgraded oil could flow into the bottom perforations of the injection well 14 if the well is completed over the whole interval or if there is not enough void space (gaseous volume downdip of the injection well) to contain the gravity drained oil from the attic. Therefore, only the top few feet are perforated in the isolated layers of the injection well 14, so the upgraded oil phase can counter-flow around and below the injected oxygen rich gas phase. High temperature thermal cement is required for this injection well completion to survive possible multiple back burns to the injection well casing as each stage of the production process is completed.

Figure 5:
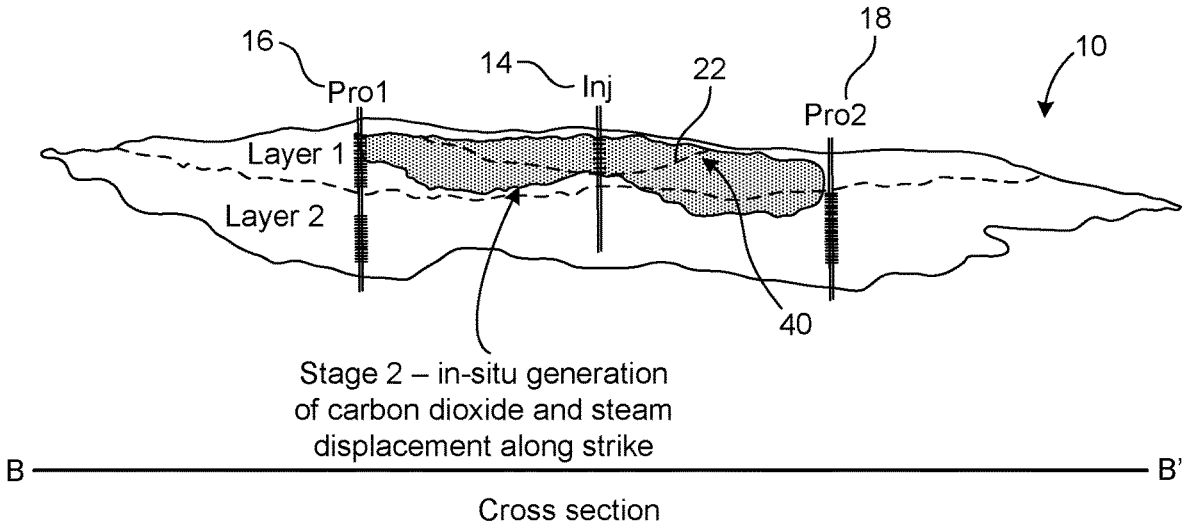
FIG. 5: End of stage 2 showing the flood front expanded along the strike of the tilted reservoir using production wells Pro1 and Pro2 with the fluid level pumped down below the perforations. The combustion front did not intercept the wellbores although the carbon dioxide and steam fronts did intercept production well Pro1 through a high permeability sand lens. An increase in bottom hole temperature to 220° F. was used to detect the proximity of the steam front to production well Pro1 and the well was shut in. Production well Pro2 was kept pumping as the steam front had not yet encroached the wellbore. Production well Pro3 was put back on production while maintaining the fluid level slightly below the depth of the perforations in injection well Inj. Micro seismic was used to track the combustion front 3-D expansion in along the strike of the reservoir towards each production well, Pro1 and Pro2.

FIG. 5 shows the strike cross section view of the tilted reservoir where the in-situ generated steam and carbon dioxide gas fronts are expanded along the strike of the reservoir by shut-in production well 20 (Pro3) and producing production wells 16 and 18 (Pro1 and Pro2). Most likely the gas fronts will expand toward one of the production wells first and that production well will have to be shut-in while the gas front expands towards the other production well. Again, the concentration of carbon dioxide gas will increase above 85% as the oxidation front approaches the production well. Meanwhile, the fluid level in the production well 20 (Pro3) will increase as the oil and water phases are gravity drained from the strike expansion of the steam and carbon dioxide fronts. When the fluid level rises to half the distance between the bottom perforation in injection well 14 (Inj) and the top of the perforations in production well 20 (Pro3), production well 20 (Pro3) is returned to production. The oil cut in production well 20 (Pro3) should increase with time to ~50% as oil saturation along strike with injection well 14 (Inj) begins to gravity drain down towards production well 20 (Pro3).

Figure 6:
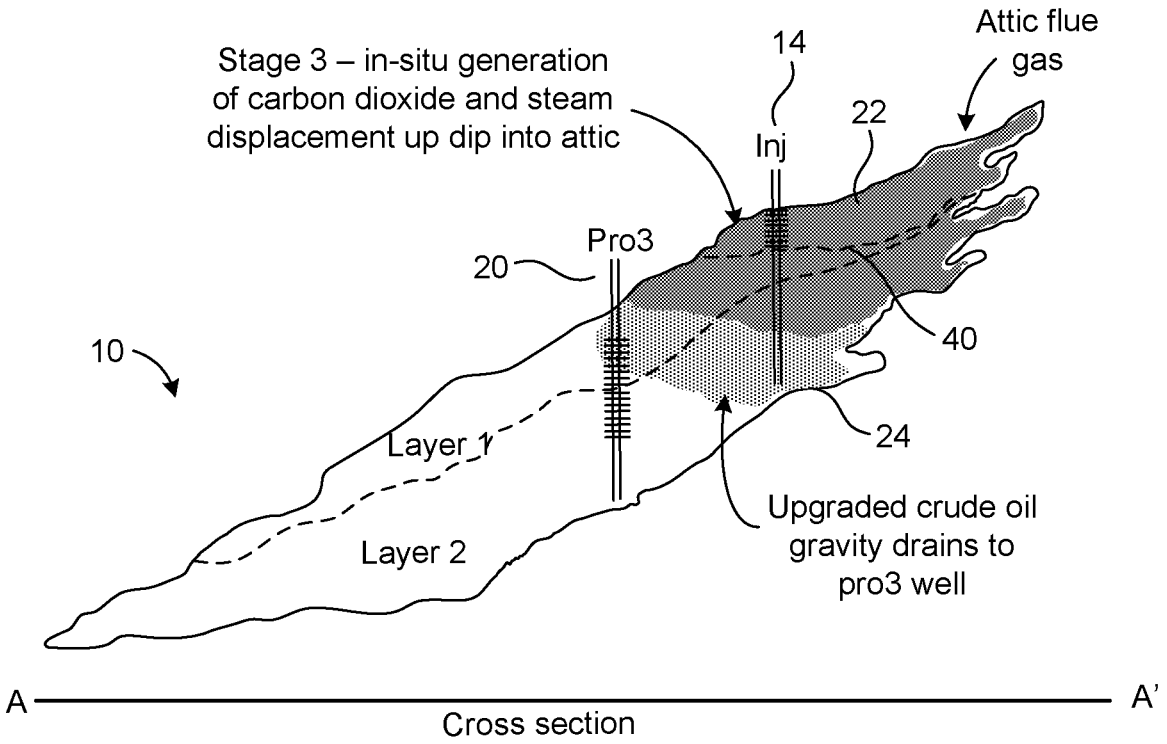
FIG. 6—Showing the A-A' cross sectional view of mature attic oil recovery with in-situ carbon dioxide and steam generation. Production fluid level in production well Pro3 is halfway between the bottom perforation of injection well Inj and the top of the perforations in production well Pro3. Gas pressure in carbon dioxide and steam chest was controlled with production well Pro1 since it was slightly more up dip. Micro seismic was used to verify the combustion front 3-D expansion into the individual pinch-out fingers in the attic. The combustion front was used to supply the heat needed for gravity stable drainage of the heavy oil phase out of the attic volume.

FIG. 6 shows the dip cross sectional view of the tilted reservoir 10 where the in-situ generated steam and carbon dioxide gas chest 22 has recovered the attic oil and is now pushing the gravity drained oil 24 bank towards down dip production well 20 (Pro3). When the oxygen injection pressure approaches the maximum injection pressure for the injection well 14 (Inj), carbon dioxide gas and steam are produced in production well 16 or 18 (Pro1 or Pro2) depending on the location of the oxidation front as determined by bottomhole temperature in the well and oxygen concentration in the produced gas. The up-dip production wells 16 or 18 (Pro1 or Pro2) can produce some of the gravity draining attic oil 24 before the production well produces a measurable oxygen gas concentration that is close to the lower ignition limit. The situation of producing oxygen gas will change as the combustion front 40 moves back and forth across the attic oil interface. Real time front location can be determined with micro-seismic events to control production from the up-dip production wells 16 or 18 (Pro1 or Pro2). The down dip production well 20 (Pro3) pumping fluid level is controlled to maintain carbon dioxide gas interface depth so that carbon dioxide gas is not prematurely produced in the production well 20 (Pro3). Gas pressure is reduced with gas production from an up-dip strike production well such as production wells 16 or 18 (Pro1 or Pro2).

After shut-in of production wells 16 and 18 (Pro1 and Pro2) the expansion of the carbon dioxide and steam fronts will reduce in the tilted reservoir 10 as reservoir pressure continues to increase, then injected gas phase oxygen and the oxidation/high-temperature combustion front 40 will gravity override in the upper couple feet of the oil reservoir until the gas phase reaches the top of the attic in each individual layer in the oil reservoir. The gas phase channel height is inversely related to oil viscosity and the tilt of the oil reservoir. Then, the oxygen-rich gas phase will begin a top-down oxidation/high-temperature combustion front 40 that is gravity stable due to the gravity drainage of up-graded, low viscosity crude oil. The injected gas phase channel from the injection well 14 to the attic will remain open while the up-graded oil and water phases gravity migrate down dip in the tilted oil reservoir filling the carbon dioxide rich gas phase void space.

Figure 7:
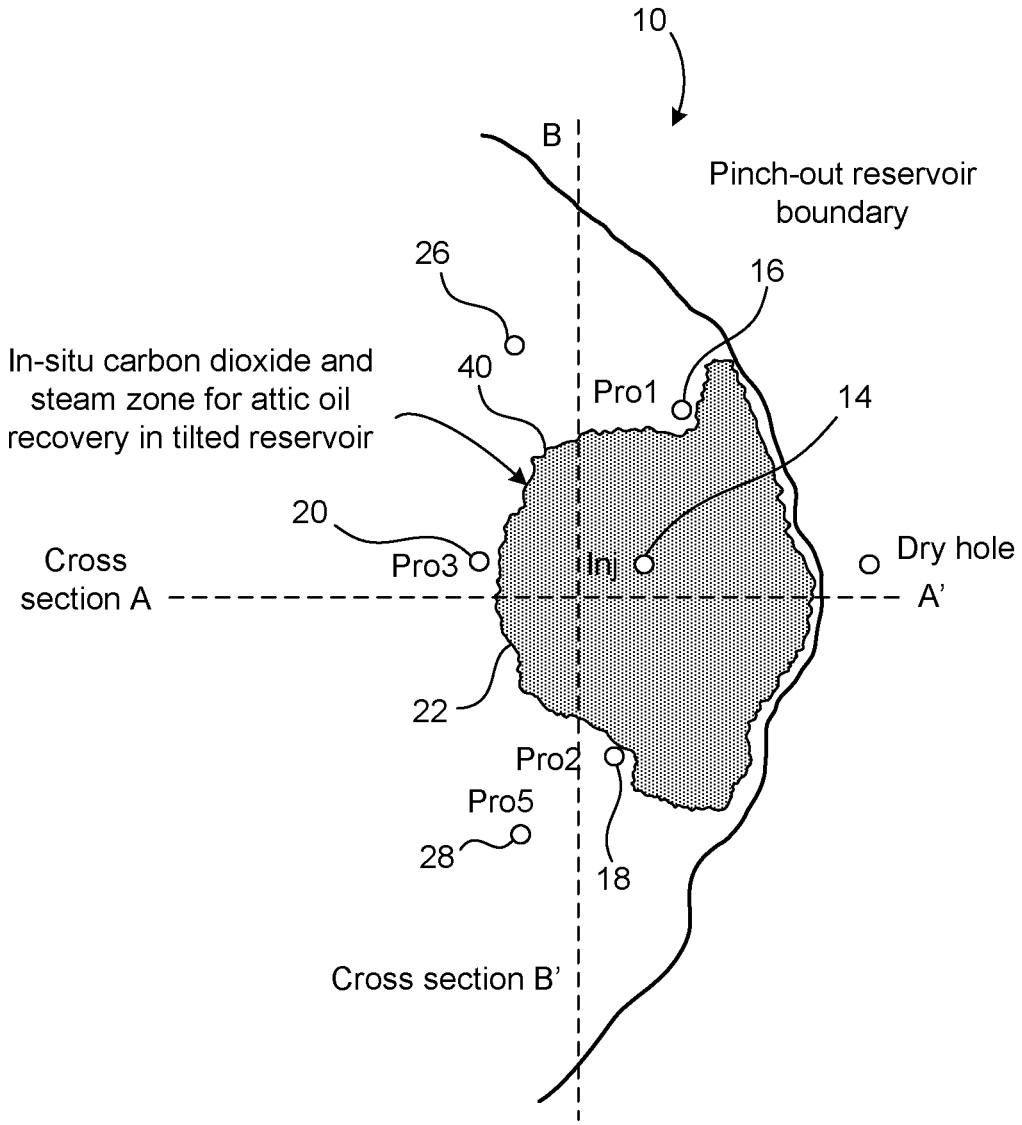
FIG. 7—Areal view of tilted reservoir at the time of conversion of Production wells Pro1 and Pro2 to oxygen gas injection wells. Perforations in production wells, Pro1 and Pro2 were protected with a temporary cement plug across the perforated interval. Combustion front swept area represented by dotted area. Production wells Pro4 and Pro5 now experiencing pressure response from carbon dioxide and steam chest expansion. Injection well Inj will be converted to recycled carbon dioxide gas injection well to maintain gas pressure in chest. Micro seismic was used to verify the combustion front 3-D expansion including the breakthrough from layer 1 into layer 2 across the thin shale layer.

FIG. 7 shows an arial view of the tilted reservoir at the time of conversion of production wells 16 and 18 (Pro1 and Pro2) to injection wells. Recycled produced carbon dioxide gas was injected into the production wells 16 and 18 to prevent the oxidation front from intercepting the production wellbores until a temporary casing plug could be set above the first perforation or a temporary cement plug set across the whole perforated interval. Nitrogen gas is not dense enough at reservoir temperature and pressure to prevent oxygen gas diffusing into the production well bore.

Two new patterns are created with down dip production wells 26 and 28 (Pro4 and Pro5) to gravity drain the attic oil. Stage 1 of producing carbon dioxide gas in the new down dip production wells 26 and 28 is not required since gas void space (gaseous volume 22) was created by the previous pattern in FIG. 4. If an additional production well is available along the strike of the tilted reservoir, then it should be produced at a low enough fluid level to draw the oxidation front towards the production well to expand the gravity drainage surface of the attic oil. After the produced gas carbon dioxide gas composition exceeds 85% in the strike production wells, the withdrawal liquid oil and water phases are managed to match the gravity drainage production from the attic oil as determined by the micro seismic image or actual carbon dioxide gas-oil ratio of the production wells. As the carbon dioxide and steam fronts expand, the carbon dioxide gas composition becomes concentrated to approximately 91% as the steam phase is condensed to liquid water. Some light hydrocarbon compounds are vaporized into the carbon dioxide gas front.

Figure 8:
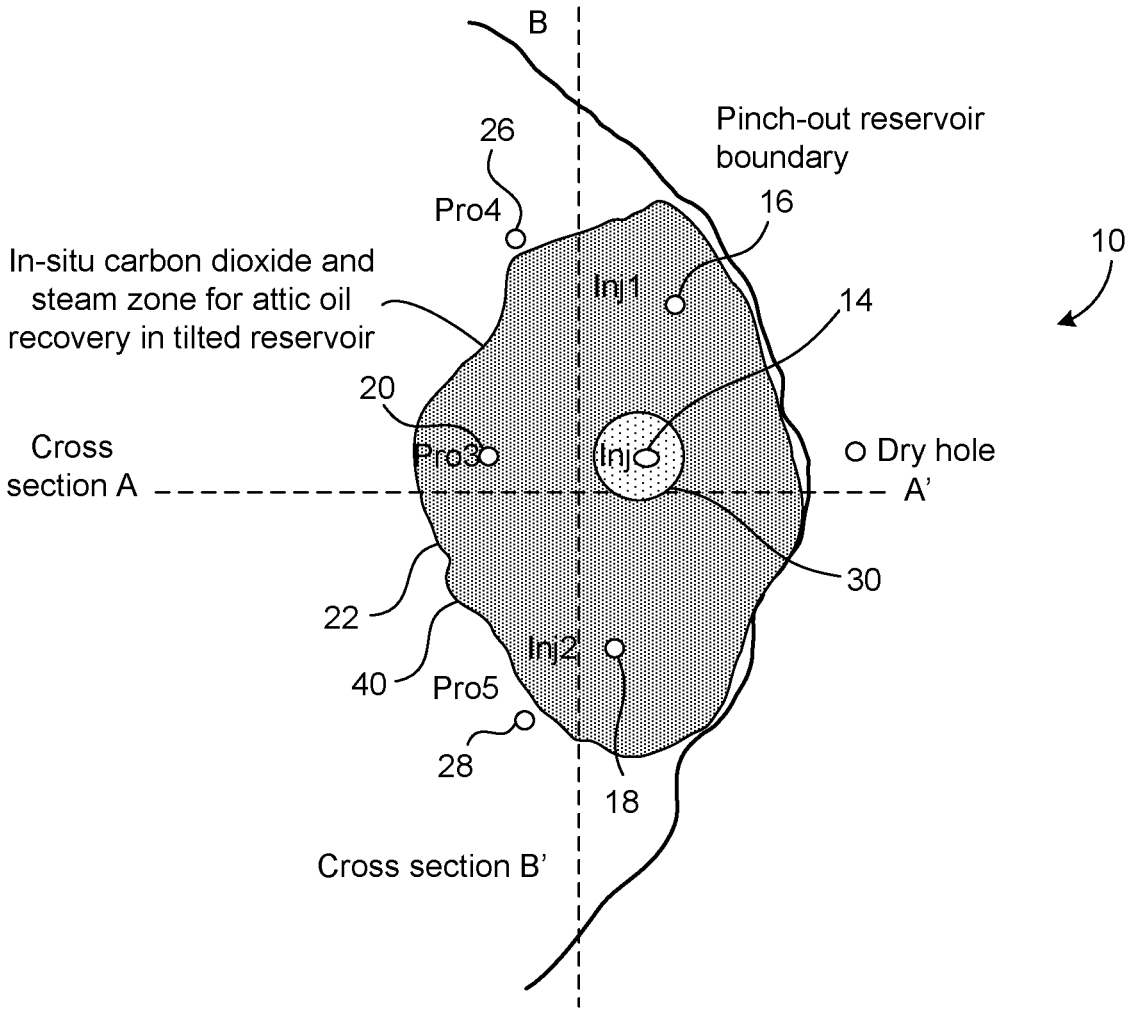
FIG. 8—Areal view of tilted reservoir at the time of conversion of Production wells Pro4 & Pro5 to oxygen gas injection wells. Perforations in production wells, Pro1 and Pro2 were plugged back to the top couple of feet to re-complete the production wells into oxygen injection wells. Combustion front swept area represented by dotted area. Production wells Pro4 and Pro5 now experiencing carbon dioxide front and steam front breakthroughs. Injection well Inj was converted to recycled carbon dioxide gas injection well and it has created a carbon dioxide rich gas front. Micro seismic was used to verify the combustion front 3-D expansion including the breakthrough from layer 1 into layer 2 across the thin shale layer.

FIG. 8 shows an aerial view of the carbon dioxide and steam fronts in a tilted reservoir expanded to production wells 26 and 28 (Pro4 and Pro5). Wells 16 and 18, which were previously production wells Pro1 and Pro2, have now been converted to oxygen injection wells, Inj1 and Inj2. The first oxygen injection well 14 was converted to a recycled carbon dioxide gas injection well and the carbon dioxide rich gas front 30 is shown in a hatched pattern. Carbon dioxide gas has molecular weight of approximately 44 g/mol and after enrichment with light cut hydrocarbons from production operations, the carbon dioxide rich gas mixture molecular weight can range from 38 to 56 g/mol. Since steam, air and enriched air have molecular weights of approximately 18, 29 and 31 respectfully, the enriched air diluted with hot steam vapor from the combustion front 40 will gravity segregate to the top of the reservoir while heavier recycled carbon dioxide rich gas will gravity segregate to the bottom of the enriched air zone surrounding the gas injection well over a month time frame. Essentially, the denser carbon dioxide preferentially migrates downdip and redirects the combustion front 40 upward in the tilted reservoir.

Figure 9:
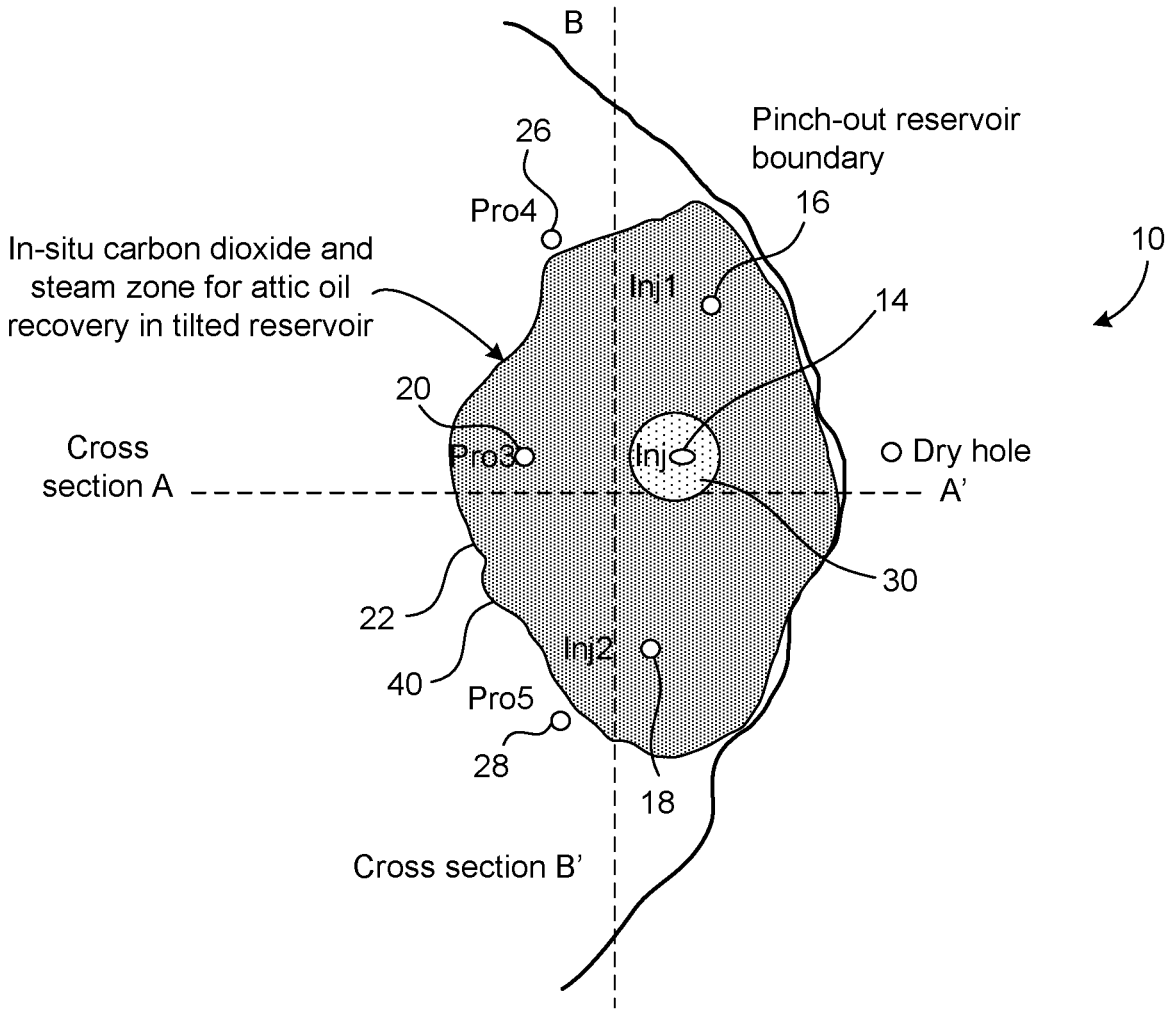
FIG. 9 shows an aerial view of the carbon dioxide and steam fronts in a tilted reservoir expanded to additional production wells.

FIG. 9 shows an aerial view of the carbon dioxide and steam fronts in a tilted reservoir expanded to production wells 26 and 28 (Pro4 and Pro5). Wells 16 and 18, which were previously production wells Pro1 and Pro2, have now been converted to oxygen injection wells, Inj1 and Inj2. The first oxygen injection well 14 was converted to a natural gas or propane gas injection well to create stationary burn front 31 around the first injection well 14 using the oxygen gas injected in injection wells 16 and 18 (Inj1 and Inj2) or using a dual completion in the original injection well 14. This will provide additional heat to expand the steam and carbon dioxide fronts faster than just the in-situ oxidation of the heavy oil in the attic. Building a stationary burn front around the injection well with co-injection of enriched air and hydrocarbon gas, will create a hot carbon dioxide rich gas front that will gravity segregate to the bottom of the enriched air zone over a two month time frame. Cycling the average pressure in the enriched air zone will cause the carbon dioxide saturated oil to release carbon dioxide gas bubbles in the pore space during the low-pressure part of the cycle, thus causing the oil phase to expand in the pore space like an oil-based foam. During the high-pressure part of the cycle the pressure increase causes the oil foam to compress back into a liquid. The liquid oil phase will gravity segregate closer to the production well with each pressure cycle. This process enhances gravity override of the gas phase into the attic oil column while enhancing the gravity underride of the liquid oil phase towards a downdip production well. The overall process of pressure cycling carbon dioxide rich gas is called augmented solution gas drive recovery of crude oil.

Many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described and accordingly, all suitable modifications and equivalents may be resorted to, falling within the scope of the invention.

We claim:

1. A method for enhanced oil recovery in a tilted reservoir comprising:

providing an injection well and at least one production well, the at least one production well provided at a greater depth in the tilted reservoir than the injection well;

injecting carbon dioxide or nitrogen gas into the injection well;

injecting enriched air into the injection well so as to cause ignition in the tilted reservoir;

reducing production by at the least one production well downdip of the injection well;

draining fluid from an area in the tilted reservoir up-dip of the injection well; and recovering the drained fluid by the at least one production well.

2. The method of claim 1, further comprising: low flow injection of air ranging from 8 Mscf/d to 50 Mscf/d for a term of less than one month in the injection well to create a coke oil zone with low temperature oxidation for a radius ranging from 20 ft to 50 ft, the coke oil zone preventing liquid oil from flowing back during the enriched air ignition of the oil reservoir.

3. The method of claim 1, further comprising:

sequestering produced carbon dioxide by injection into the injection well.

4. The method of claim 1, the step of injecting carbon dioxide or nitrogen gas into the injection well comprising creation of a buffer zone around a wellbore of the injection well for suppressing an initial pressure pulse from ignition in the tilted reservoir.

5. The method of claim 1, wherein prior to the step of reducing production by the at least one production well, a combustion front created after ignition will move downdip in the tilted reservoir toward the at least one production well.

6. The method of claim 4, wherein after the step of reducing withdrawal by the at least one production well, the combustion front moves up-dip in the tilted reservoir toward an attic of the tilted reservoir.

7. The method of claim 1, wherein the enriched air is an oxygen gas mixture comprising between 0 and 65 vol % nitrogen gas, less than 6 vol % argon gas, between 0 and 80 vol % carbon dioxide gas, less than 5 vol % hydrocarbon gas, and between 25 and 96 vol % oxygen gas.

8. The method of claim 1, wherein the injection well utilizes an injection tubing comprising at least one of a composite plastic coating and a fiberglass tubing withing steel tubing, the method further comprising the step of: injecting fogged or foamed freshwater with 2-7% surfactant and 10-67% glycerin to form a liquid film to protect the injection tubing.

9. The method of claim 1, wherein the injection well comprises a plurality of injection wells respectively provided in isolated layers or attic pinch-out fingers of the tilted reservoir.

10. The method of claim 9, further comprising: microseismic and/or seismic tracking of at least one combustion front created after ignition in the tilted reservoir.

11. The method of claim 1, wherein the at least one production well comprises a plurality of production wells, the method further comprising: converting one or more of the plurality of production wells into one or more injection wells for injecting enriched air.

12. The method of claim 10, further comprising: converting one or more of the converted production wells into one or more carbon dioxide injection wells; and redirecting a combustion front upwardly in the tilted reservoir by injecting carbon dioxide in the carbon dioxide injection well or wells.

13. The method of claim 10, further comprising: converting one or more of the converted production wells into one or more hydrocarbon injection wells; and establishing a stationary combustion front to expand steam and carbon dioxide fronts upwardly in the tilted reservoir or downwardly into an oil layer.

14. The method of claim 1, further comprising: cycling a pressure in the location in the tilted reservoir updip of the production well by adjusting at least one of an injection gas rate in the injection well and a production rate in the at least one production well.

15. The method of claim 13, wherein the pressure is cycled by at least 200 psi.

* * * * *